US007281943B1

(12) United States Patent
Yamaji

(10) Patent No.: US 7,281,943 B1
(45) Date of Patent: Oct. 16, 2007

(54) CONNECTOR

(75) Inventor: Takahiro Yamaji, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/708,513

(22) Filed: Feb. 20, 2007

(30) Foreign Application Priority Data

Feb. 21, 2006 (JP) ..... 2006-043911

(51) Int. Cl.
*H01R 12/24* (2006.01)

(52) U.S. Cl. ..... 439/495; 439/83

(58) Field of Classification Search ..... 439/79, 439/83, 492, 493, 495, 497, 607
See application file for complete search history.

(56) References Cited

U.S. PATENT DOCUMENTS 4,425,015 A * 1/1984 Rizzo ..... 439/83
4,971,565 A * 11/1990 Fox, Jr. ..... 439/74
5,145,386 A * 9/1992 Berg et al. ..... 439/83
5,197,891 A * 3/1993 Tanigawa et al. ..... 439/83
5,564,949 A * 10/1996 Wellinsky ..... 439/607

FOREIGN PATENT DOCUMENTS

JP 2000-039621 A 2/2000
JP 2004-327244 A 11/2004

* cited by examiner

*Primary Examiner*—Khiem Nguyen
(74) *Attorney, Agent, or Firm*—Collard & Roe, P.C.

(57) ABSTRACT

A connector configured to be fixed on a base member comprises a housing, a plurality of contacts and a pair of supporting members. The housing has a main portion and end portions arranged at opposite ends of the main portion. The contacts are retained in the housing. The supporting members are attached to the housing at the end portions. The respective supporting member comprises an upper portion, a lower portion, an upper arm and a lower arm. The end portion is arranged between the upper portion and the lower portion. The upper arm and the lower arm have an upper contact portion and a lower contact portion, respectively, which are configured to be mounted on the base member.

12 Claims, 9 Drawing Sheets

CONNECTOR

BACKGROUND OF THE INVENTION

This invention relates to a connector and, more particularly, to a connector configured to be fixed on a base member, such as a circuit board.

For example, known connectors of this type are disclosed in JP-A 2004-327244 and JP-A 2000-39621.

The connector disclosed in JP-A 2004-327244 comprises a housing elongated along a predetermined direction and a shell arranged to cover the housing. The shell comprises an upper plate and a lower plate. The housing is arranged between the upper plate and the lower plate. The shell further comprises a pair of plate-like contacts outwardly projecting from opposite ends of the lower plate along the predetermined direction. When the disclosed connector is mounted on a circuit board, the plate-like contacts is soldered so that the lower plate is fixed on the circuit board.

The connector disclosed in JP-A 2000-39621 is elongated along a predetermined direction. The connector comprises a pair of metal plates attached at opposite ends of an upper part of the connector in the predetermined direction. The metal plates are fixed on a circuit board by screws so that the upper part of the connector is fixed on a circuit board.

SUMMARY OF THE INVENTION

It is an object of the present invention to provide a connector comprising a supporting member configured to be fix on a base member more surely than the disclosed techniques.

According to an aspect of the present invention, there is provided a connector configured to be fixed on a base member. The connector comprises a housing, a plurality of contacts and a pair of supporting members. The housing has a main portion and end portions arranged at opposite ends of the main portion. The contacts are retained in the housing. The supporting members are attached to the housing at the end portions of the housing, respectively. The respective supporting member comprises an upper portion, a lower portion, an upper arm and a lower arm. The end portion of the housing is arranged between the upper portion and the lower portion. The upper arm has an upper contact portion configured to be mounted on the base member. The upper arm is extending from the upper portion at least to the upper contact portion. The lower arm has a lower contact portion configured to be mounted on the base member. The lower arm is extending from the lower portion at least to the lower contact portion.

According to another aspect of the present invention, there is provided a connector configured to be fixed on a base member. The connector comprises a housing, a plurality of contacts retained in the housing and a shell attached to the housing. The shell comprises a pair of supporting portions and an extension. The housing are arranged between the supporting portions. The extension interconnects the supporting portions and covers at least a part of the housing. The respective supporting member comprises an upper portion, a lower portion, an upper arm and a lower arm. The upper arm has an upper contact portion configured to be mounted on the base member and extends from the upper portion at least to the upper contact portion. The lower arm has a lower contact portion configured to be mounted on the base member and extends from the lower portion at least to the lower contact portion.

These and other objects, features and advantages of the present invention will become more apparent upon reading of the following detailed description along with the accompanied drawings.

DESCRIPTION OF PREFERRED EMBODIMENTS

Figure 1:
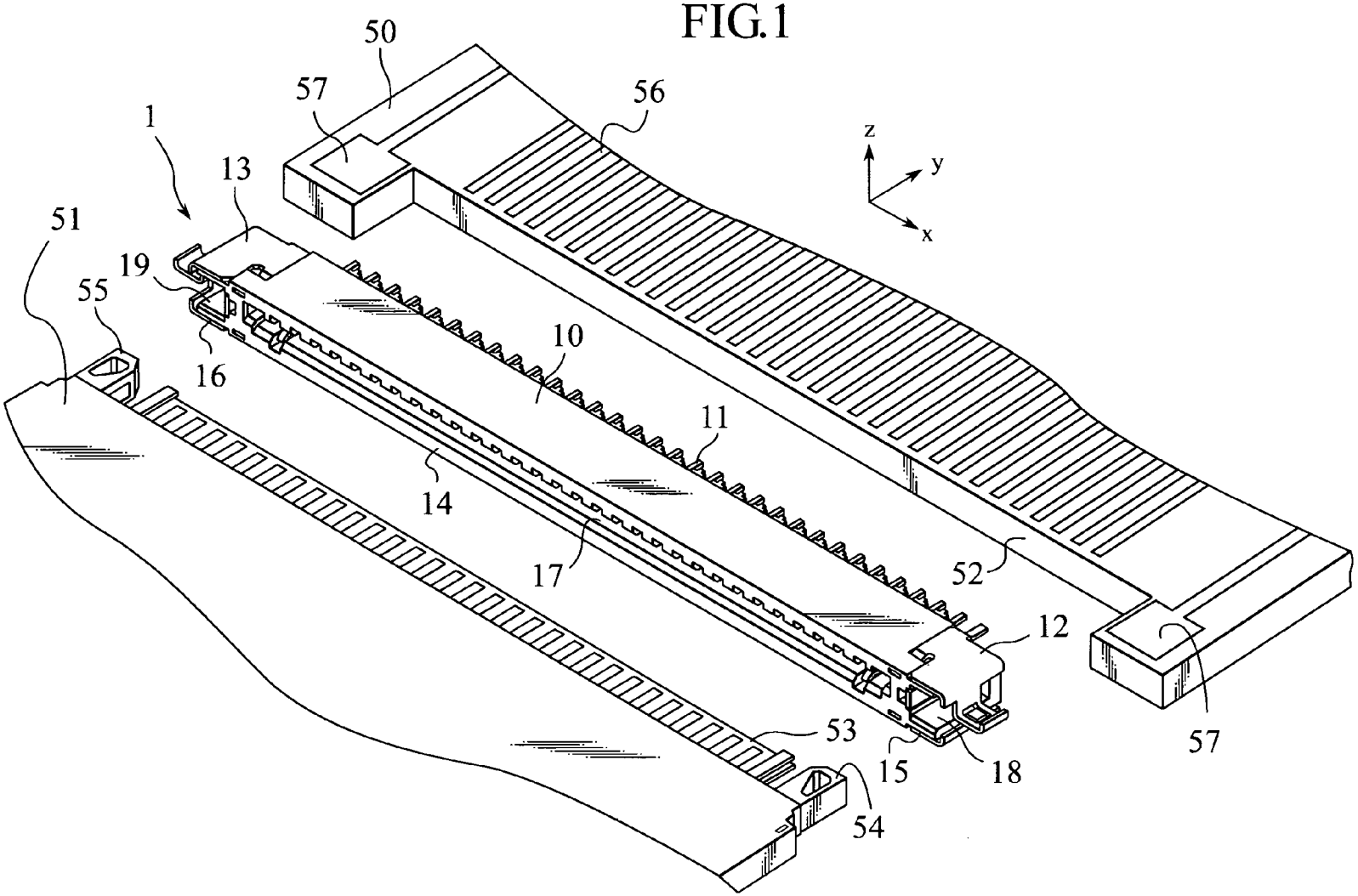
FIG. 1 is an exploded perspective view of a connector according to an embodiment of the present invention, a base member and a mating connector.

Referring to FIG. 1, a connector 1 of an embodiment of the present invention is configured to be fixed to a board 50. The board 50 is formed with a depressed edge 52 of a wide U-shape. The depressed edge 52 defines a connector accommodation portion configured to accommodate the connector 1. The board 50 comprises a plurality of traces 56 and a pair of pads 57 configured to be electrically connected with the connector 1. The depressed edge 52 is defined between the pads 57.

The connector 1 is configured to be mated with a mating connector 51. The mating connector 51 of this embodiment comprises a front edge elongated along an x-direction, a plate-like projection 53 projecting from the front edge in a y-direction and guide posts 54 and 55 projecting along the y-direction from opposite ends of the front edge.

Figure 2:
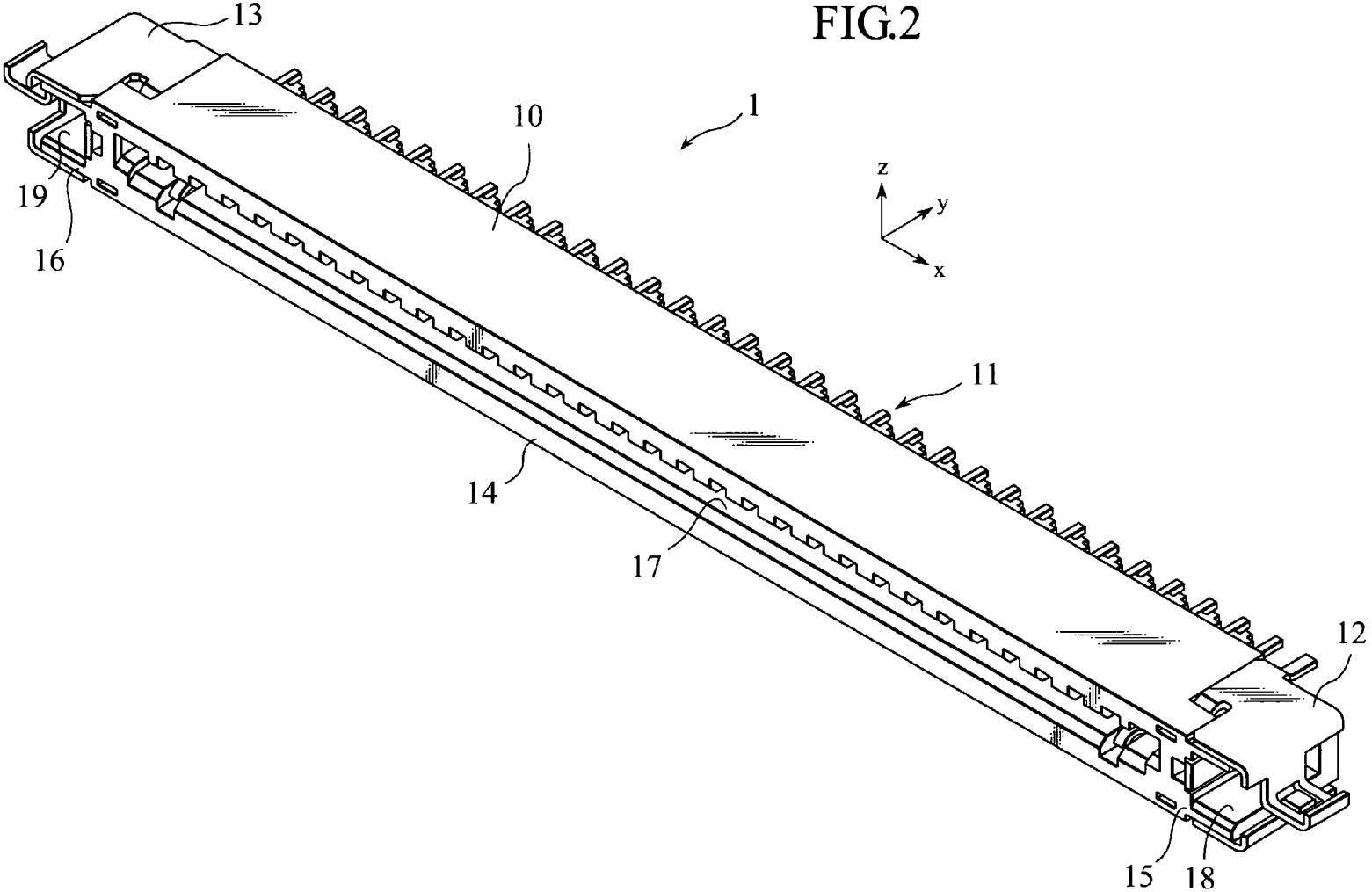
FIG. 2 is a perspective view of the connector of FIG. 1.

Referring to FIG. 2, the connector 1 comprises a housing 10, a plurality of contacts 11 and first and second supporting members 12 and 13.

The housing 10 has a main portion 14 and first and second end portions 15 and 16 which are formed integrally with each other by molding dielectric material.

The main portion 14 is elongated along the x-direction and has a receptacle 17. The receptacle 17 is opened forwardly and recessed rearwardly along the y-direction. The receptacle 17 of the connector 1 is configured to receive the plate-like projection 53 illustrated in FIG. 1.

Figure 3:
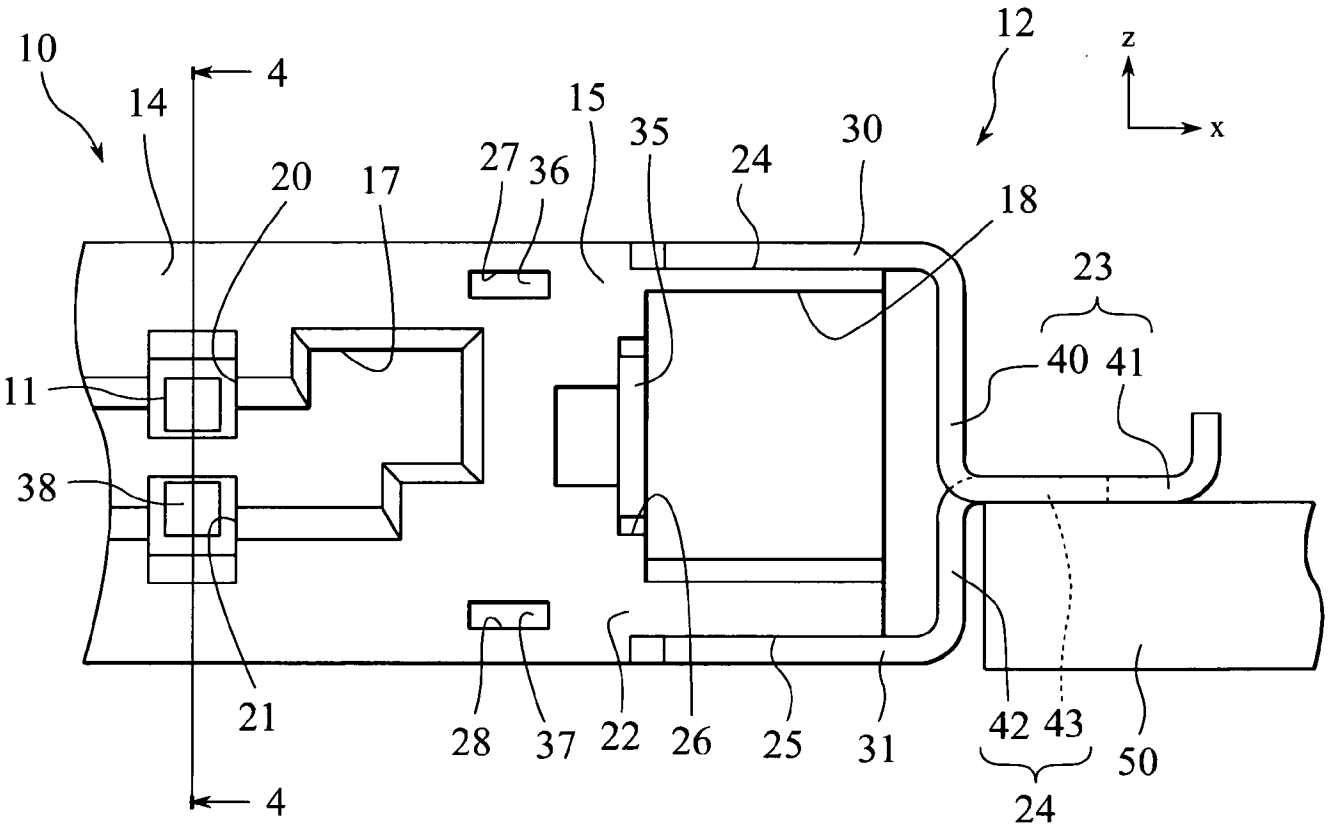
FIG. 3 is a partial, front view of the connector of FIG. 2.
Figure 4:
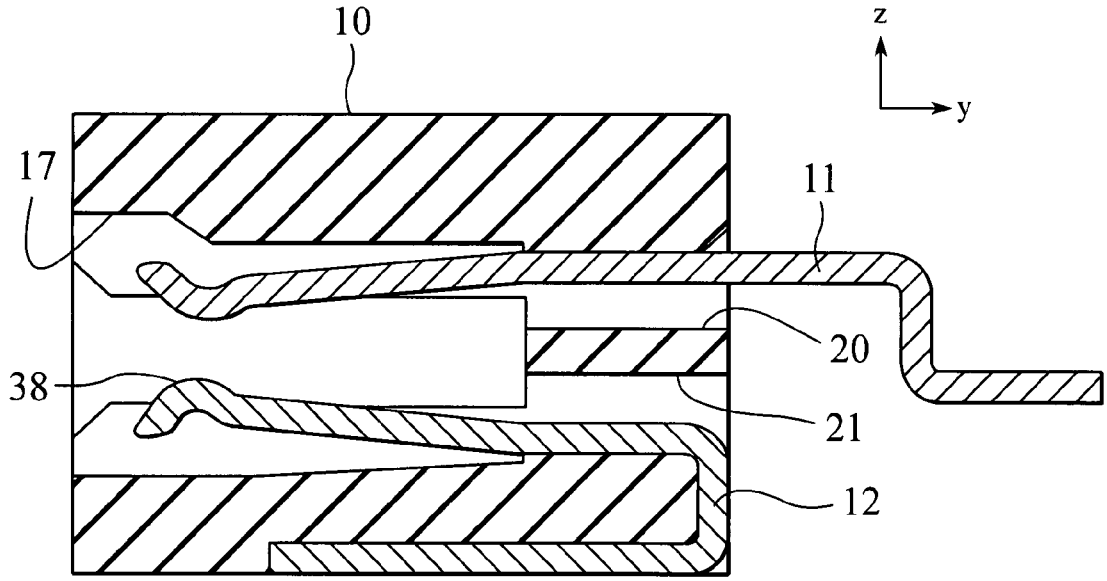
FIG. 4 is a cross sectional view of the connector taken along the line 4-4 of FIG. 3.

FIG. 3 is a partial front view of the connector 1. FIG. 4 is a cross sectional view of the connector 1 taken along the line 4-4 of FIG. 3. Referring to FIG. 2, the main portion 14 has a plurality of contact retention holes 20. Referring to FIG. 4, the respective contact retention hole 20 is arranged to rearwardly pierce the main portion 14 from a rear end of the receptacle 17 and retains the contact 11. The contact 11 is arranged to project inwardly into the receptacle 17 from the contact retention hole 20 and to project outwardly from the contact retention hole 20. The contacts 11 are electrically connected with the traces 56 on the board 50 when the connector 1 is mounted on the board 50.

The main portion 14 further has first and second contact retention holes 21 arranged at opposite ends of the receptacle 17 in the x-direction. The first and the second contact retention holes 21 are arranged to pierce the main portion 14 rearwardly from the rear end of the receptacle 17 and arranged lower than the contacts 11.

Referring back to FIG. 2, the first and the second end portions 15 and 16 are arranged at outside opposite ends of the main portion 14 in the x-direction. The first and the second end portions 15 and 16 have first and second guide cavities 18 and 19. The first and the second guide cavities 18 and 19 are opened forwardly and elongated rearwardly and are further opened outwardly along the x-direction, respectively. The first and second guide cavities 18 and 19 are configured to receive the guide posts 54 and 55 illustrated in FIG. 1, respectively.

Figure 5:
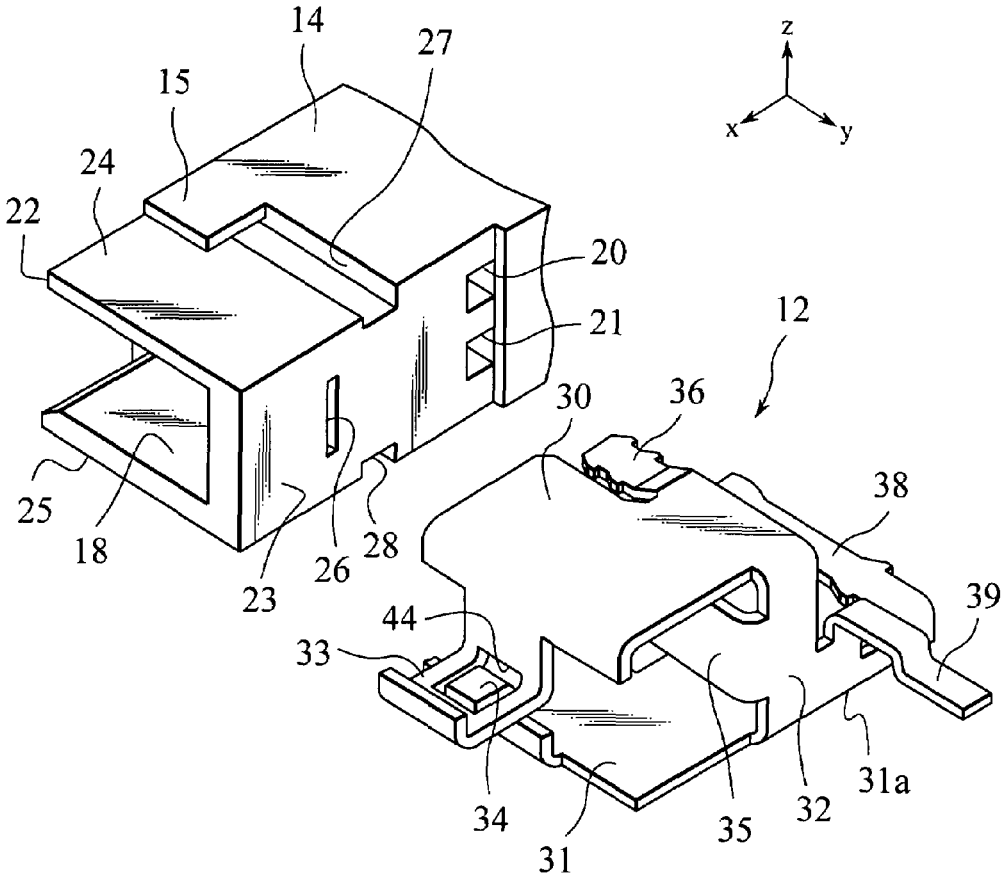
FIG. 5 is a partial, exploded, rear perspective view of the connector of FIG. 2.
Figure 6:
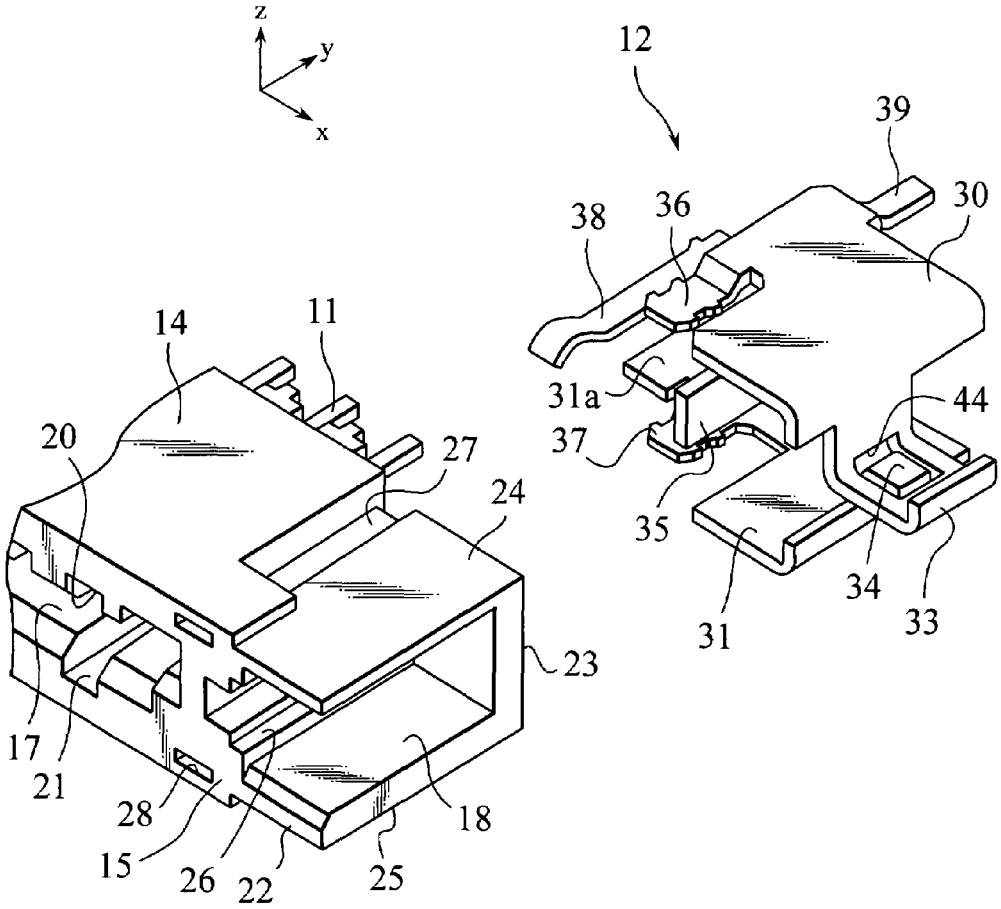
FIG. 6 is a partial, exploded, front perspective view of the connector of FIG. 2.

Referring to FIG. 5 and FIG. 6, the first end portion 15 has a front surface 22 and a rear surface 23 arranged at opposite outsides in the y-direction and an upper surface 24 and a lower surface 25 arranged at opposite outsides in a z-direction. The first end portion 15 further comprises a lock plate receiving cavity 26, an upper retention cavity 27 and a lower retention cavity 28.

The lock plate receiving cavity 26 is opened rearwardly and elongated forwardly. The lock plate receiving cavity 26 is arranged between the main portion 14 and the first guide cavity 18 and is connected with the first guide cavity 18 in the first end portion 15.

The upper and the lower retention cavities 27 and 28 are arranged on the upper surface 24 and the lower surface 25, respectively. The upper and the lower retention cavities 27 and 28 are both arranged between the main potion 14 and the lock plate receiving cavity 26 and are elongated from the rear surface 23 to the front surface 22. The upper retention cavity 27 has an upwardly opened groove-like rear part and a hole-like front part. The lower retention cavity 28 has a downwardly opened groove-like rear part and a hole-like front part.

The first and the second end portions 15 and 16 are mirror symmetrical structures.

Referring to FIG. 5, the first supporting member 12 of this embodiment is stamped and formed from a single metal sheet and is attached to the first end portion 15. The first supporting member 12 comprises an upper plate 30, a lower plate 31, a connection section 32, an upper arm 33, a lower arm 34, a lock plate 35, an upper retention portion 36, a lower retention portion 37, a first contact 38 and a first lead 39.

Referring to FIG. 5, the upper and the lower plates 30 and 31 are extending along the x-direction and the y-direction. Referring to FIG. 3, the upper and the lower plates 30 and 31 cover the upper and the lower surfaces 24 and 25 of first end portion 15, respectively so as to cover the first guide cavity 18. The lower plate 31 has a plate-like projection part 31*a* projecting toward the second supporting member 13 along the x-direction.

Referring to FIG. 5, the connecting section 22 is extending between rear ends of the upper and lower plates 30 and 31 along the z-direction.

Referring to FIG. 3, the upper arm 33 is arranged at an outside edge of the upper plate 30 in x-direction and has an L-like shape. 3. The upper arm 33 has an upper extension 40 and an upper contact portion 41. The upper extension 40 is projecting from the upper plate 30 downwardly. The upper extension 40 has an end positioned between the upper plate 30 and the lower plate 31. The upper contact portion 41 is elongated outwardly from the end of the upper extension 40 along the x-direction. The upper contact portion 41 has an upwardly curved free end.

Referring to FIG. 3, the lower arm 34 is arranged at an outside edge of the lower plate 31 in x-direction and has an L-like shape. The lower arm 34 has a lower extension 42 and a lower contact portion 43. The lower extension 42 is projecting from the lower plate 31 upwardly. The lower extension 42 has an end positioned between the upper plate 30 and the lower plate 31. The lower contact portion 43 is elongated outwardly from the end of the lower extension 42 along the x-direction.

Figure 7:
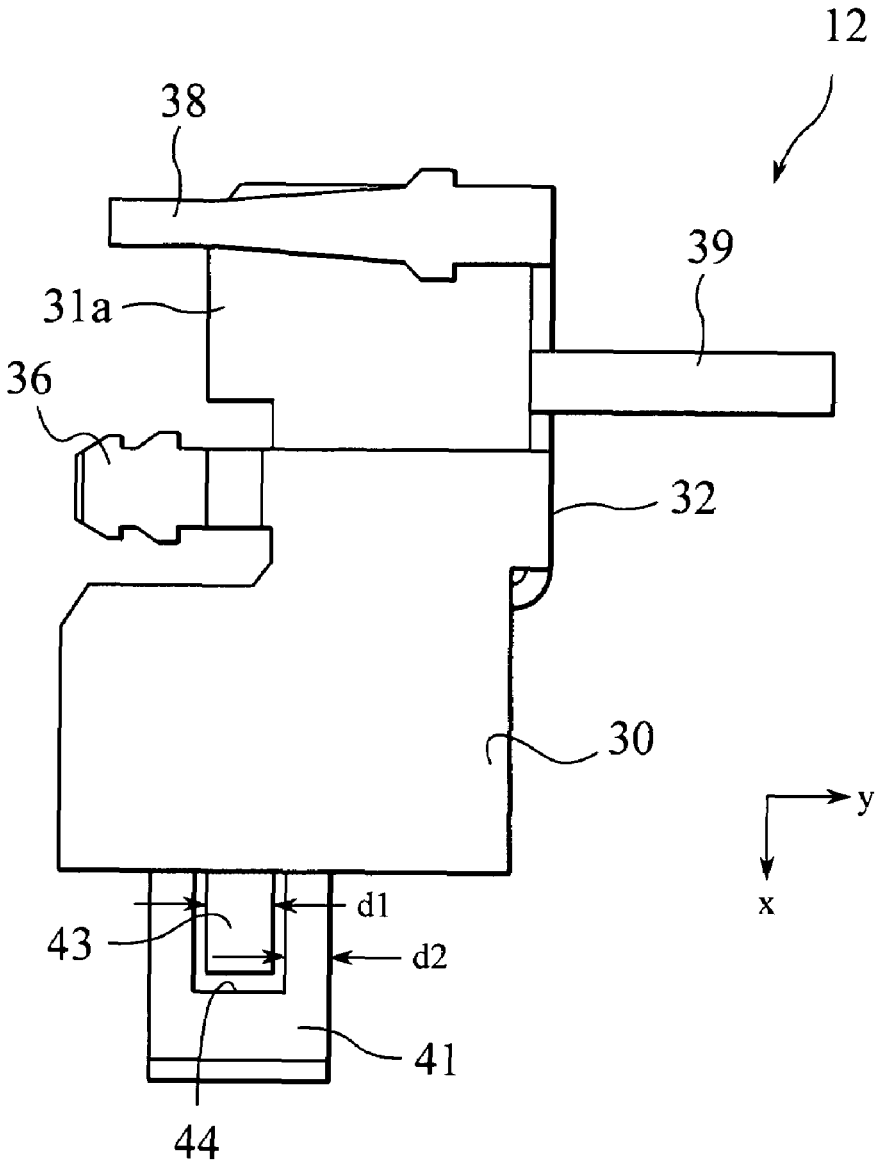
FIG. 7 is a plan view of the supporting member of FIG. 2.

As shown in FIG. 3, the upper and the lower contact portions 41 and 43 have first and second surfaces, respectively. The first and the second surfaces are fixed on a surface of the board 50 when the connector 1 is mounted on the board 50. Referring to FIG. 7, the upper contact portion 41 of this embodiment has an aperture 44 piercing the upper contact portion 41 in the z-direction. The lower contact portion 43 is arranged in the aperture 44 and is soldered on the pad 57 of the board 50 with the upper contact portion 41.

The lower contact portion 43 has a width d1 in the y-direction. The upper contact portion 41 has a frame defining the aperture 44. The frame has a width d2 in the y-direction. The width d1 is twice as wide as the width d2, preferably. Preferably, the upper arm 33 and the lower arm 34 are arranged near the front surface 22. The lower contact portion 43 may have an aperture and the upper contact portion 41 may arranged in the aperture of the lower contact portion 43.

Figure 8:
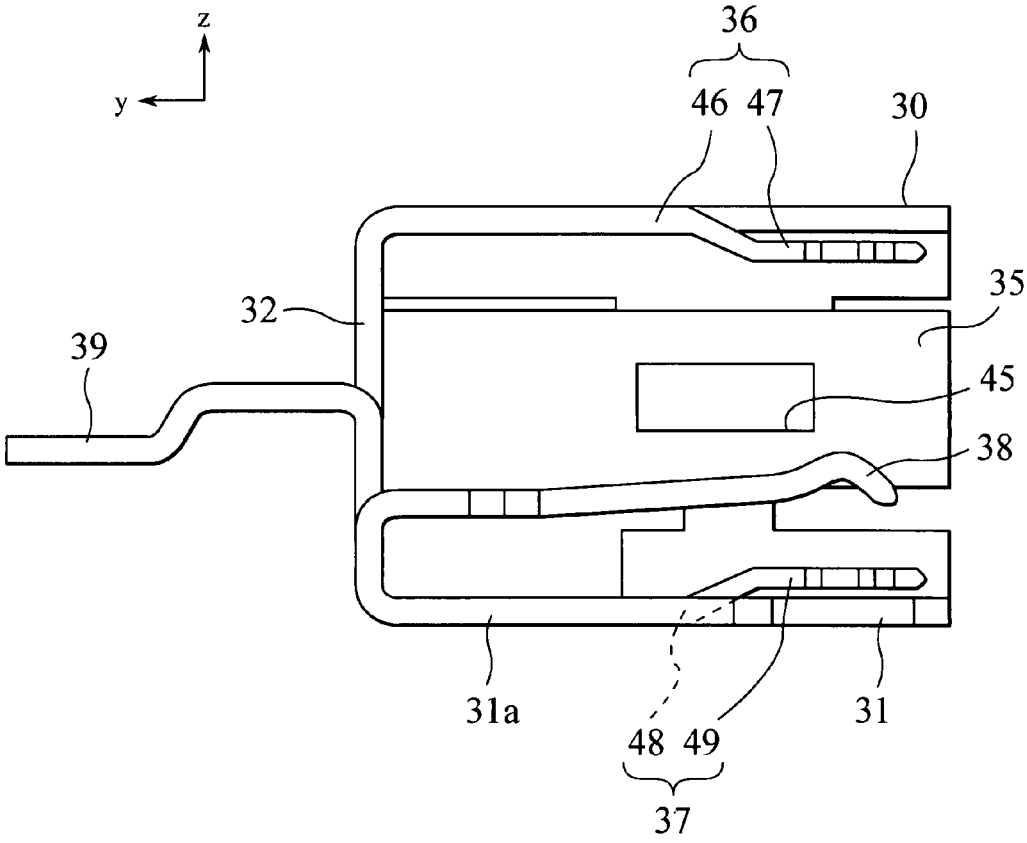
FIG. 8 is a side view of the supporting member of FIG. 2.

Referring to FIG. 8, the lock plate 35 is forwardly extending from the connection section 32 and is positioned between the upper plate 30 and the lower plate 31. The lock plate 35 has a rectangular shape extending in the y-direction and the z-direction and has a lock aperture 45 piercing the lock plate 35 along the x-direction. As shown in FIG. 3, the lock plate 35 is inserted in the lock plate receiving cavity 26 from the rear surface 23 of the first end portion 15 so that the first supporting member 12 is attached to the housing 10. The lock aperture 45 is configured to receive a hook (not shown) of the guide post 54 illustrated in FIG. 1. Preferably, the lock plate 35 is urged into the first guide cavity 18.

Referring to FIG. 5, the upper and the lower retention portions 36 and 37 are forwardly extending from the connection section 32 and lies adjacent to the upper and the lower plates 30 and 31, respectively. The upper retention portion 36 has an upper rear part 46 and an upper front part 47. The upper rear part 46 is extended from rear half part of the upper plate 30 along the x-direction and is formed by a single plate with the upper plate 30. The upper front part 47 is forwardly extending from the upper rear part 46 and is arranged lower than the upper rear part 47. The lower retention portion 37 has a lower rear part 48 and a lower front part 49. The lower rear part 48 is extended from rear half part of the lower plate 31 along the x-direction and is formed by a single plate with the lower plate 31. The lower front part 49 is forwardly extending from the lower rear part 48 and is arranged higher than the lower rear part 48.

The upper and the lower retention portions 36 and 37 are guided by the groove-like rear part of the upper and the lower retention cavities 27 and 28, respectively, and inserted and pressed into the hole-like front part thereof when the first supporting member 12 is fully attached to the first end portion 15.

Referring to FIG. 7, the first contact 38 is projecting forwardly from a rear edge of the plate-like projection part 31*a*. Referring to FIG. 4, when the first supporting member 12 is fully attached to the first end portion 15, the first contact 38 is inserted in the first contact retention hole 21.

Referring to FIG. 7, the first lead 39 is projecting rearwardly from the rear edge of the plate-like projection part 31*a* and is configured to be contact with the traces 56 on the board 50.

The first and the second supporting members 12 and 13 are mirror symmetrical structures.

Figure 9:
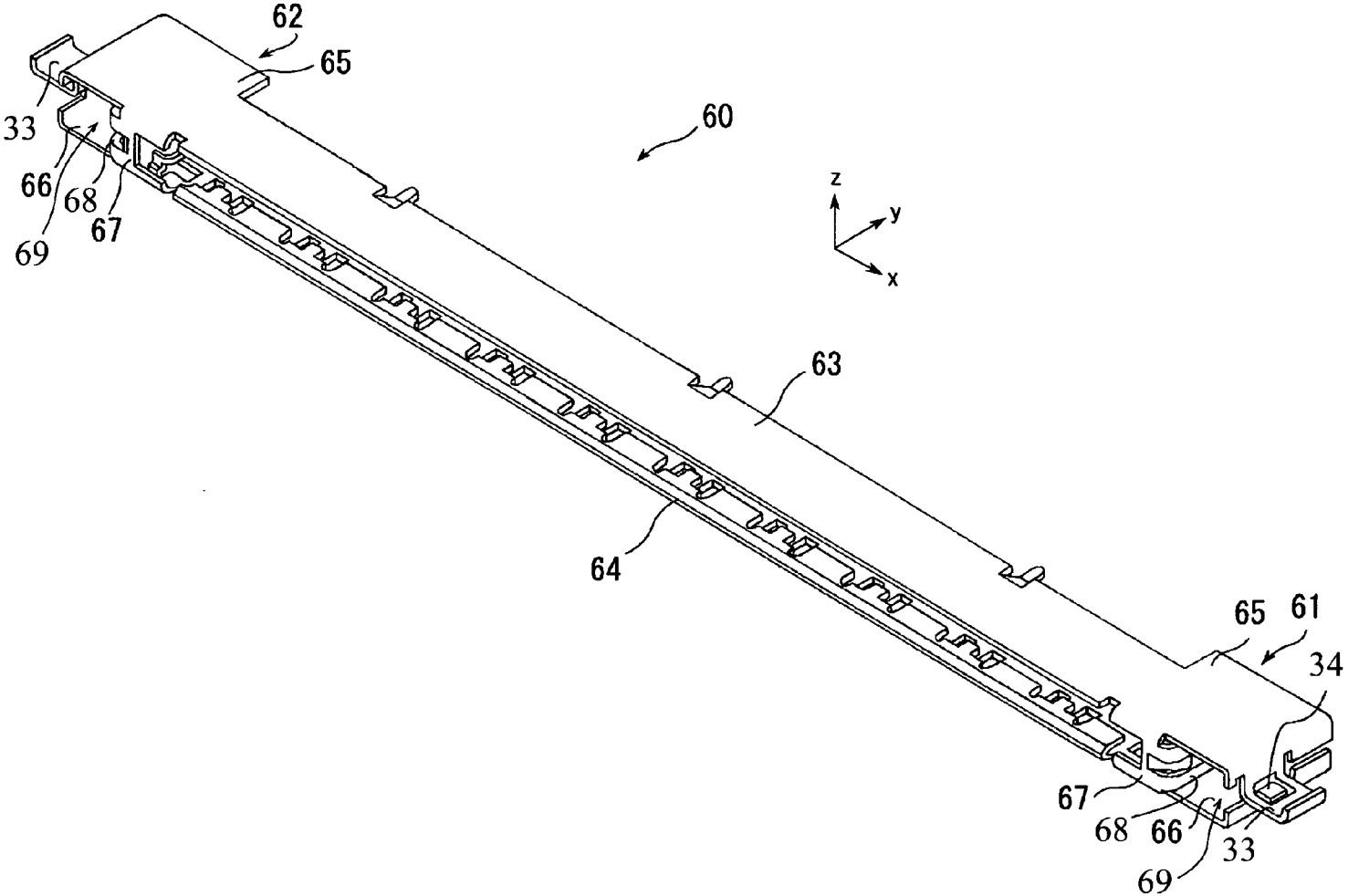
FIG. 9 is a perspective view of a shell according to another embodiment of the present invention.

Referring to FIG. 9, a connector of another embodiment of the present invention may comprises a shell 60 which includes first and second supporting portions 61 and 62 and upper and lower extensions 63 and 64. The shell 60 is stamped and formed from a single metal sheet and is attachable to a housing.

Each of the first and the second supporting portions 61 and 62 comprises upper plate 65, lower plate 66, connection section 67 and lock plate 68 and further comprises the upper arm 33 and the lower arm 34 of the former embodiment.

The upper plates 65 are extending along the x-direction and y-direction and are connected with opposite ends of the upper extension 63 in the x-direction. The lower plates 66 are extending along the x-direction and y-direction and are connected with opposite ends of the lower extension 64. The upper plates 65 are arranged above the lower plates 66, respectively. The upper plate 65 and the lower plate 66 define a guide cavity 69 therebetween. The guide cavities 69 defined in the first and second supporting portions 61 and 62 are configured to receive the guide posts 54 and 55 of the mating connector 51 shown in FIG. 1.

The upper and the lower extensions 63 and 64 are elongated along the x-direction and are configured to cover at least a part of the housing.

The upper arm 33 and the lower arm 34 are connected to outside edges of the upper plate 65 and the lower plate 66 in x-direction, respectively.

The connection section 67 is extending from a front edge of the upper plate 65 to a front edge of the lower plate 66 along the z-direction. The lock plate 68 is rearwardly projecting from the connection section 67.

This application is based on Japanese Patent Application serial no. 2006-043911 filed in Japan Patent Office on Feb. 21, 2006, the content of which is incorporated herein by reference in its entirety.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be constructed as being included therein.

What is claimed is:

1. A connector configured to be fixed on a base member comprising:

a housing having a main portion and end portions arranged at opposite ends of the main portion;

a plurality of contacts retained in the housing;

a pair of supporting members attached to the housing at the end portions of the housing, respectively; and the respective supporting member comprising:

an upper portion;

a lower portion, wherein the end portion of the housing is arranged between the upper portion and the lower portion;

an upper arm having an upper contact portion configured to be mounted on the base member, and the upper arm extending from the upper portion at least to the upper contact portion; and a lower arm having a lower contact portion configured to be mounted on the base member, and the lower arm extending from the lower portion at least to the lower contact portion.

2. The connector according to claim 1, wherein the respective end portion has a guide cavity arranged between the upper portion and the lower portion and configured to receive a guide post of a mating connector.

3. The connector according to claim 1, wherein:

the respective end portion has a front surface and a rear surface;

the guide cavity is opened at the front surface; and the supporting member further includes a connecting portion extending between the upper portion and the lower portion along the rear surface.

4. The connector according to claim 3, wherein:

the respective end portion further comprises a rearwardly opened cavity; and the supporting member further comprises a retention portion configured to be inserted in the rearwardly opened cavity.

5. The connector according to claim 4, wherein the retention portion is positioned forward of the connecting portion.

6. The connector according to claim 1, wherein:

one of the upper contact portion and the lower contact portion has an aperture; and the rest of the upper contact portion and the lower contact portion is arranged in the aperture.

7. The connector according to claim 1, wherein:

the base member has an depressed edge; and the supporting members are configured to fix the connector at the depressed edge.

8. The connector according to claim 1, wherein:

the upper contact portion has a first surface;

the lower contact portion has a second surface; and the first surface and the second surface are configured to be fixed on a surface of the base member.

9. The connector according to claim 1, further comprising an extension interconnecting the supporting members.

10. The connector according to claim 1, wherein the upper contact arm and the lower contact arm have L-shape.

11. A connector configured to be fixed on a base member comprising:

a housing;

a plurality of contacts retained in the housing;

a shell attached to the housing;

the shell comprising a pair of supporting portions and an extension;

the housing arranged between the supporting portions; and the extension interconnecting the supporting portions and covering at least a part of the housing; and the respective supporting member comprising:

an upper portion;

a lower portion;

an upper arm having an upper contact portion configured to be mounted on the base member, and the upper arm extending from the upper portion at least to the upper contact portion; and a lower arm having a lower contact portion configured to be mounted on the base member, and the lower arm extending from the lower portion at least to the lower contact portion.

12. The connector according to claim 11, wherein the respective supporting member has a guide cavity arranged between the upper portion and the lower portion, and the guide cavity configured to receive a guide post of a mating connector.

* * * * *